United States Patent [19]

Delery

[11] Patent Number: 4,856,210

[45] Date of Patent: Aug. 15, 1989

[54] CLOSING DEVICE FOR SKI BOOTS AND THE LIKE

[75] Inventor: Marc Delery, Caluire, France

[73] Assignee: Skis Rossignol, France

[21] Appl. No.: 143,590

[22] Filed: Jan. 13, 1988

[30] Foreign Application Priority Data

Jan. 20, 1987 [FR] France ..... 87 00743

[51] Int. Cl.[4] ..... A43B 5/04; A43C 11/00

[52] U.S. Cl. ..... 36/117; 36/50; 24/68 SK

[58] Field of Search ..... 36/117–121, 36/50; 24/68 SK, 69 SK, 70 SK, 71 SK

[56] References Cited

U.S. PATENT DOCUMENTS

| | | | |
|---|---|---|---|
| 3,790,991 | 12/1974 | Hanson et al. | 36/117 X |
| 4,083,130 | 4/1978 | Bertetto et al. | 36/117 |
| 4,096,648 | 6/1978 | Guolo | 36/50 |
| 4,553,292 | 11/1985 | Pradier et al. | 24/70 SK |
| 4,624,063 | 11/1986 | Delery | 36/117 |

FOREIGN PATENT DOCUMENTS

| | | | |
|---|---|---|---|
| 2631398 | 2/1977 | Fed. Rep. of Germany | 36/120 |
| 1330758 | 5/1963 | France . | |
| 2373981 | 7/1978 | France . | |
| 2441355 | 6/1980 | France . | |
| 2573632 | 5/1986 | France . | |
| 130715 | 3/1929 | Switzerland | 24/69 SK |
| 617075 | 5/1980 | Switzerland . | |

*Primary Examiner*—James Kee Chi

*Attorney, Agent, or Firm*—Wall and Roehrig

[57] ABSTRACT

A closing device for ski boots and the like, composed of a strapping (7) comprising a flexible cord (8) in the form of a closed loop, one of the ends (10) of which is secured to one of the edges (5) of the part (4) of the boot allowing it to be opened and the other end (14) of which can be subjected to the action of a lever (9) capable of pivoting about a pivot pin (11) provided on the other edge (6) of the part of the boot allowing it to be opened, in order to exert a pull to ensure closing. The pivoting lever (9) is mounted permanently on the boot and possesses, over its length, a continuous slot (15), in which the end (11) of the loop (8) on which the pull is exerted slides freely, in such a way that the two ends of the flexible cord (8) in the form of a closed loop are kept permanently on either side of the two edges of the element of the boot allowing it to be opened and closed.

6 Claims, 4 Drawing Sheets

CLOSING DEVICE FOR SKI BOOTS AND THE LIKE

The invention relates to an improved closing device for boots, especially for ski boots, climbing boots and the like, more particularly boots obtained as a result of the injection molding of a synthetic material, especially thermoplastic.

Hitherto, it has been possible to divide injection-molded ski boots into two main groups according to the way in which they are opened in order to fit them and remove them, namely those which are opened by means of two flaps on top and those which are opened by means of a cap pivoting at the front or at the rear. The most common solution for ensuring the closing of the collar, the flaps or the cap of the shell is to use an assembly which is conventionally referred to by the term "strapping" and which, in general terms, is composed, on the one hand, of a lever-shaped lever having a series of teeth making it possible to adjust the tightness of fit of the boot, this lever being mounted pivotally on a support or base secured on one side of the cut-out part of the shell or of the collar ensuring closing, and, on the other hand, of a closed flexible loop secured on the other side.

Such a solution, the general principle of which has been proposed for a very long time, is described in FR-A-1,330,758 in particular, gives good results, but has a certain number of disadvantages, both technical and economic, which are well known to technicians and are therefore not mentioned again and which explain the very large number of proposals made hitherto for overcoming them. Of these solutions, that which is the subject of FR-A-2,373,981 and its addition 2,410,449 (corresponding to US-A-4,150,500) may be mentioned.

This solution, in which the pivoting lever is integral with the free end, makes it necessary, during closing, to position the end of the said lever with great accuracy against an element forming a stop, this being an operation which may even be difficult for an adult to carry out and is virtually impossible for a young child. Moreover, when the boot is open, the flexible-loop/lever assembly hangs down along the boot. Finally, these disadvantages are further aggravated where rear-opening boots are concerned.

Now an improvement to such a type of strapping has been found and is the subject of the present invention, this not only overcoming its disadvantages, but also making it possible, when the boot is open, to ensure that the movable parts are held relative to one another, thus assisting walking. Furthermore, the solution according to the invention is particularly suitable for boots opening at the rear and will be described in terms of such a use, on the understanding that this is not limiting and that it can also apply to other types of boots.

In general terms, the improved boot-closing device according to the invention is composed of a strapping comprising a flexible cord in the form of a closed loop, one of the ends of which is secured to one of the edges of the part of the boot allowing it to be opened, and the other end of which can be subjected to the action of a lever capable of pivoting about a pivot pin provided on the other edge of the part of the boot allowing it to be opened, in order to exert a pull making it possible to ensure the closing of the boot, and is defined in that the pivoting lever is mounted permanently on the boot and possesses, over its length, a continuous slot, in which the end of the loop on which the pull is exerted can slide freely, in such a way that the two ends of the flexible loop are kept permanently on either side of the two edges of the element of the boot allowing it to be opened and closed.

If such strapping is used on a rear-opening ski boot which, in general terms, is composed of a shell intended for receiving the foot, of a rear guard mounted pivotally on the said shell and of a front collar making it possible, in interaction with the rear guard, to grip the leg, the means according to the invention which are intended for ensuring closing will be secured to the two rear edges of the collar which partially surrounds the guard, the flexible closed loop being connected permanently to these two edges at the rear of the boot, both in the open position for fitting and removal and in the closed position.

According to this embodiment, the fixed part of the loop will be mounted on the edge of the collar, so that it can be shifted between several positions in order to change the degree of tightness. Such a possibility of shifting can be obtained, for example, by giving the corresponding edges of the collar the form of a tongue projecting slightly relative to the axis of the boot, this tongue having, on the one hand, at its end a slot for the passage of the loop and, on the other hand, stops which are arranged at a distance from one another and of which there are, for example, three, and within which the end of the said loop can be retained. Of course, any other system of adjustment could be used, for example systems utilizing micrometer screwing or any other equivalent system.

Moreover, the pivoting lever is mounted on the other side of the collar either by means of a metal base attached by riveting (or an equivalent means, such as clipping, welding, buttoning etc.) or, if appropriate on a molded bearing forming an integral part of the collar. The length of the pivoting lever will be a function of the size of the boot and of the length of the slot ensuring the retention and guidance of the movable end of the loop, against which the pull is exerted during tightening. Finally, this end of the loop cord will preferably be rigid, this being achieved, for example, by covering it with a U-shaped metal part.

The invention and the advantages which it affords will be understood better, however, from the exemplary embodiment which is given below as an indication and in a non-limiting way and which is illustrated in the accompanying figures of which:

Figure 1:
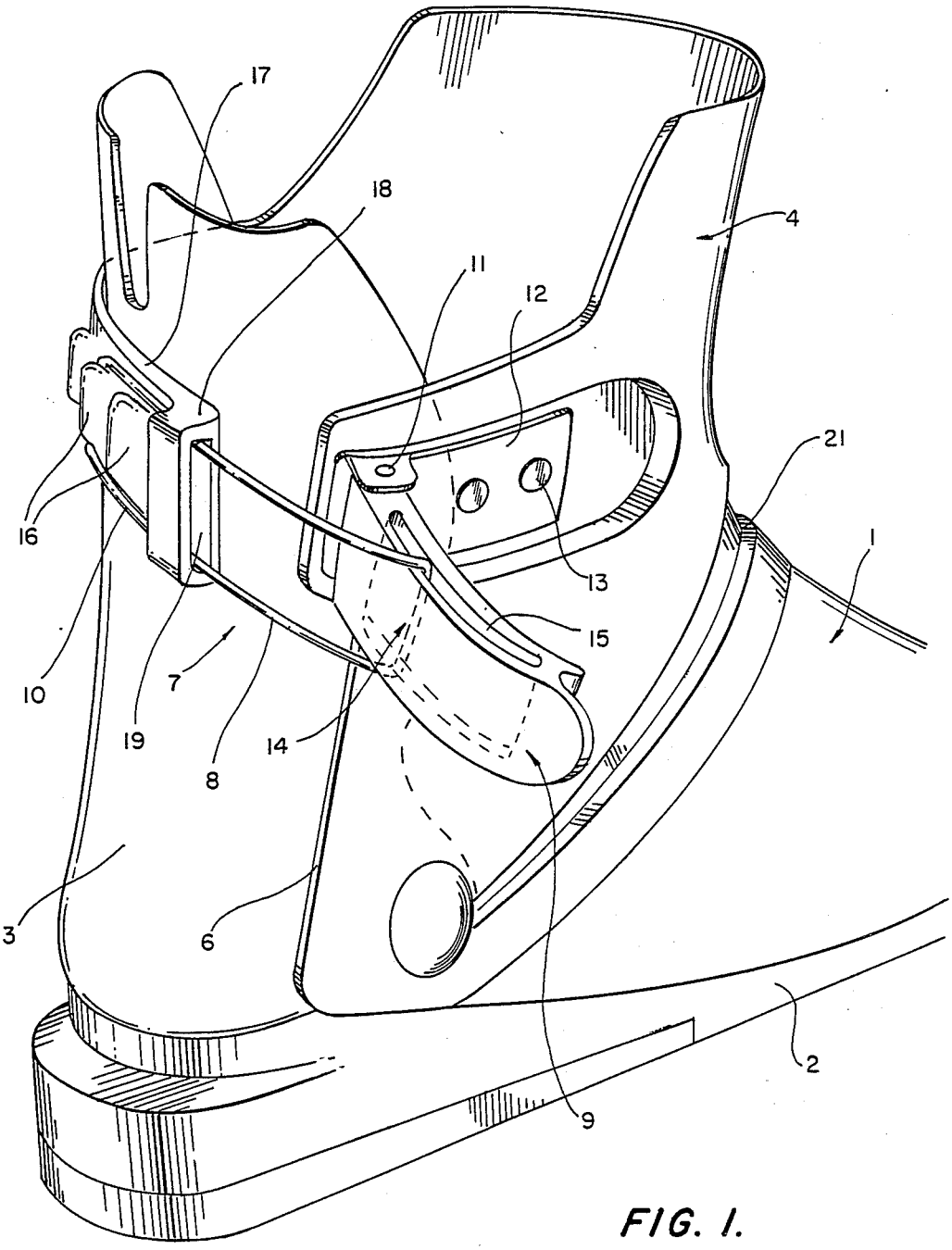
FIG. 1 is a perspective view of the rear of a ski boot possessing a closing device according to the invention.

Referring to the accompanying figures and more particularly to FIG. 1, the ski boot which is equipped with a closing device according to the invention and which, in this particular case, is a rear-opening boot is composed essentially of a shell (1) made of injected plastic, in which the sole (2) is molded directly. In a known way, this shell (1) has associated with it, on the one hand, an articulated guard (3) at the rear and, on the other hand, a collar (4) surrounding the shell at the front and the guard (3) over some of its height. This collar (4) is open at the rear, and its edges (5, 6) project over the guard. To ensure that the boot is closed, according to the invention, a strapping, designated by the general reference (7), is associated with the collar (4) in such a way as to make it possible to bring together the edges (5, 6) of the said collar and consequently allow the guard (3) to pivot forwards, in order to ensure the closing of the boot. A slipper is, of course, arranged inside the assembly as a whole.

Figure 2:
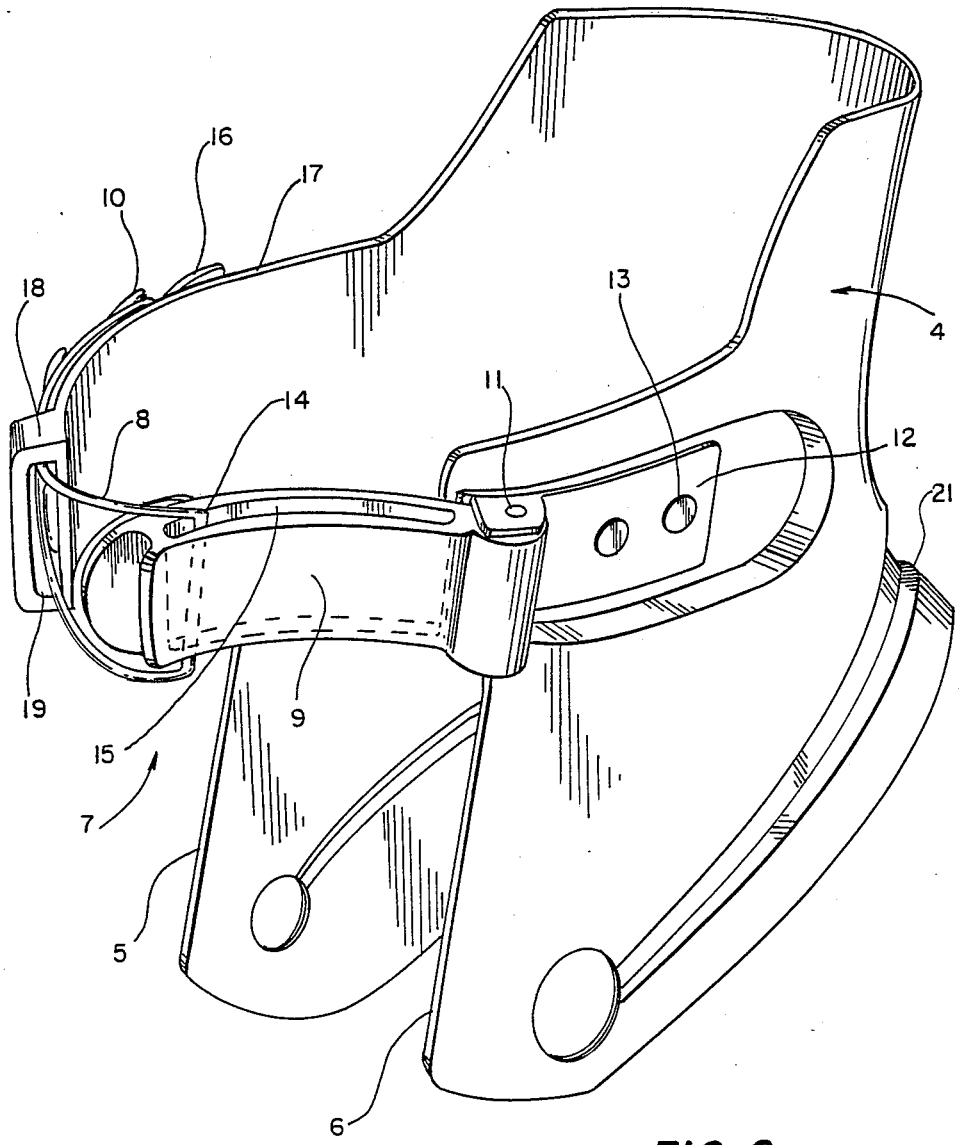
FIG. 2 is likewise a perspective view of the sleeve belonging to such a boot, this being the element to which the closing means according to the invention are secured.

According to the invention, as emerges clearly from FIGS. 1 and 2, the assembly forming the strapping and mounted on the collar (4) comprises, on the one hand, a flexible cord in the form of a closed loop (8) and, on the other hand, a lever (9). The end (10) of the loop (8) is mounted fixedly on the edge (5) of the collar, whilst the lever (9) is likewise mounted fixedly on a pivot pin (11) on the other side (6) of the collar (4). In this embodiment, the lever (9) is secured by means of a base (12) attached by means of rivets (13) in the collar. This base (12) is arranged in a groove obtained during the molding of the collar. According to the invention, the end (14) of the loop (8), on which the action of the lever (9) is to be exerted, is mounted inside a slot (15) made in the lever (9). This slot (15) has a radius of curvature corresponding to that of the lever (9) which is such that, when the boot is closed, it can be laid against the surface of the recess in which the base (12) is secured.

In the embodiment illustrated in the accompanying diagrams, the end (10) is secured to the edge (5) by means of stops (16), of which there are three in this particular case and which are arranged along a tongue (17) an integral part of the edge (5) and projecting at the rear of the boot, so that it can cover this rear part at least partially and, in general, in such a way that when the boot is closed to its maximum position, the end (18) of the tongue (17) comes in contact with the opposite edge (6) of the collar. The retaining stops (16) are arranged in the extension of a slot (19) provided at the front of the tongue (17) and allowing the cord (8) to be guided. The end of the loop (8) mounted within the slot (15) of the pivoting lever is covered with a metal sheath making it easier for it to slide within the said slot and preventing the loop from becoming worn during use.

Figure 3:
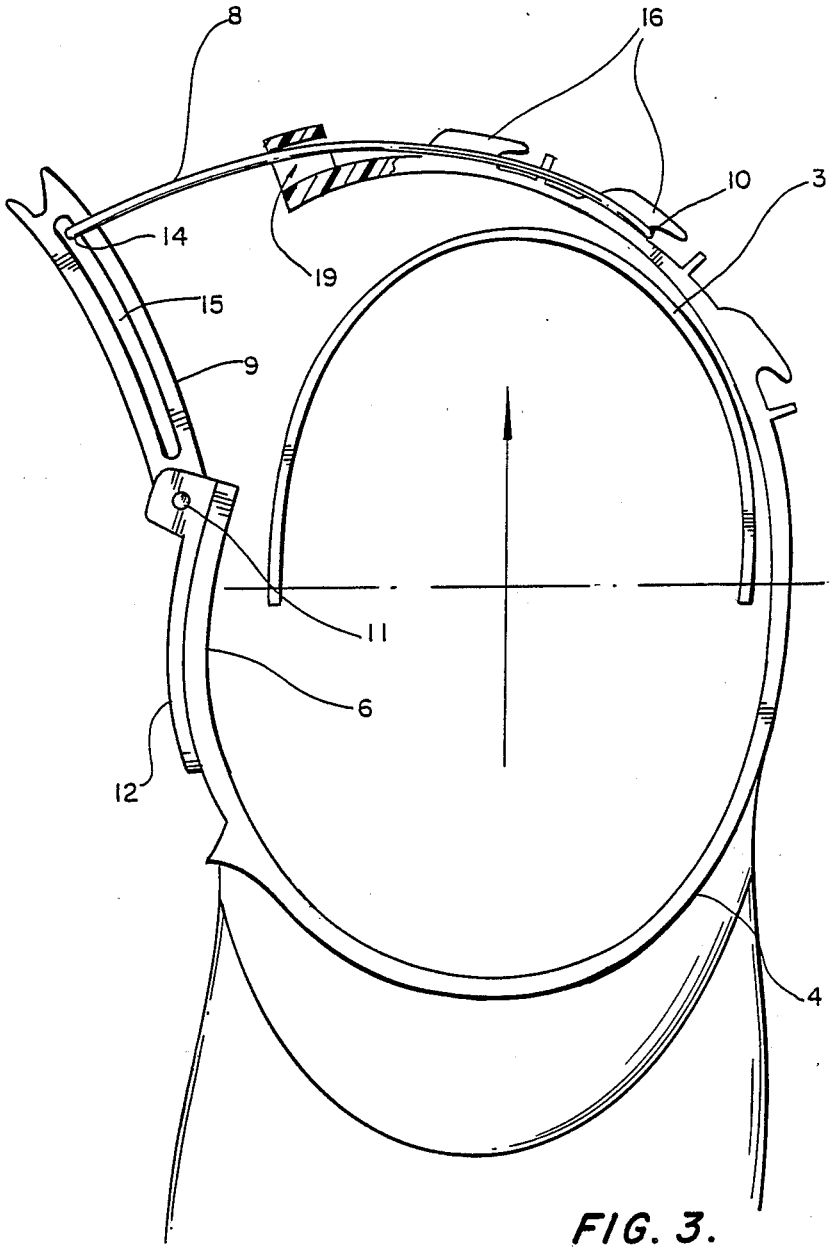
FIGS. 3 and 4 are sectional plan views showing the functioning of a closing device according to the invention in the open position in FIG. 3 and after closing in FIG. 4.
Figure 4:
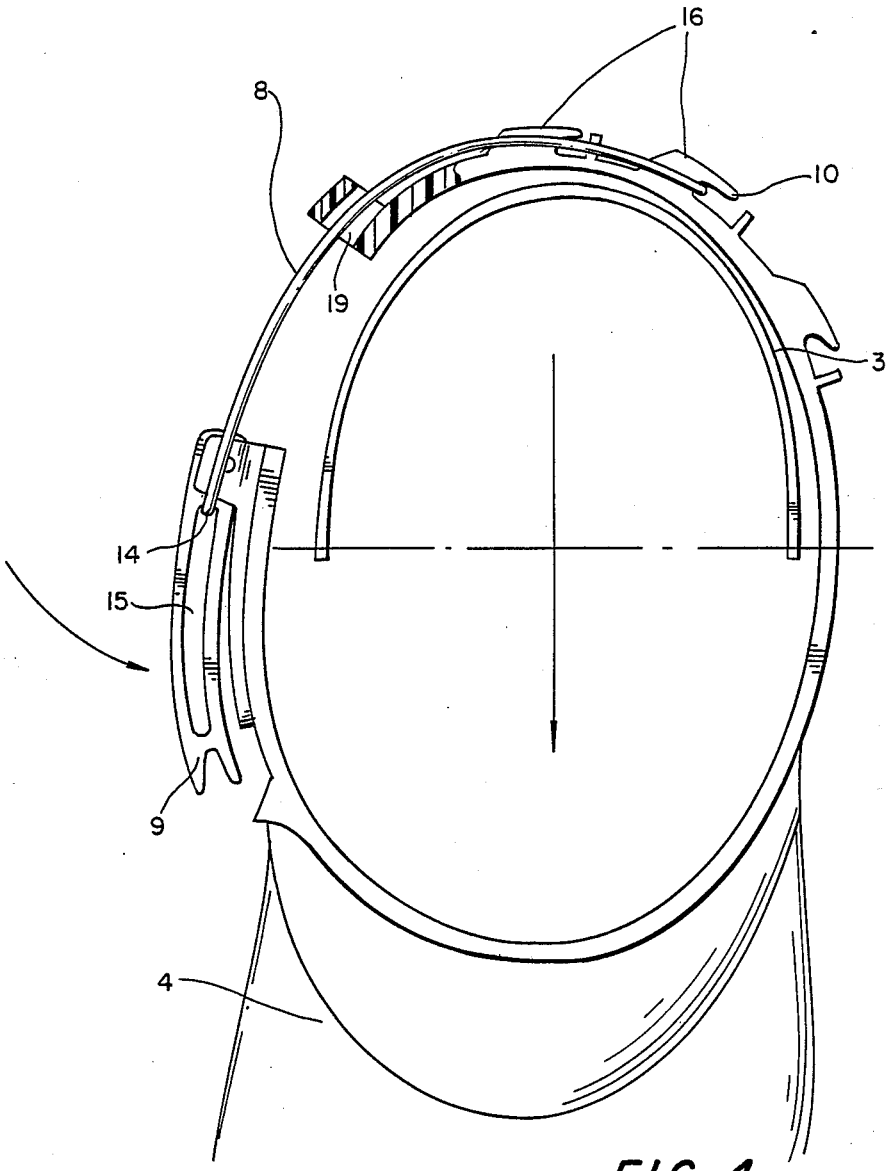

The functioning of such a closing device emerges clearly from FIGS. 3 and 4. In the open position illustrated in FIG. 3 (and in FIGS. 2 and 1), the lever is brought to the rear, and the loop can slide freely within the slot (15), thus making it possible to tilt the guard (3) to the rear. When the boot is to be closed (FIG. 4), it is sufficient to exert a pull on the end of the lever to ensure that this pull is automatically transmitted to the end of the loop which causes the guard (3) to be carried forwards and the boot tightened progressively.

Moreover, to give the collar a certain flexibility in the forward direction, the latter is preferably produced in one piece, as shown in FIG. 2, and has a flexibility zone (21). This flexibility zone is obtained, during molding, by producing the collar in one piece and by providing a peripheral slit with a stop projecting slightly forwards. When the collar is fitted, it is sufficient to insert the projecting stop inside by passing it through the orifice. The part (21) can therefore slide slightly against the inner face of the collar during normal use and thus allows a certain flexibility in the forward direction.

The closing device according to the invention is not only simple and cheap to produce, but, in comparison with prior solutions, has a large number of advantages, of which one which can be mentioned is that, since the lever and the flexible loop-shaped cord are always connected to one another and to the boot, no element hangs down at the side when it is open. Furthermore, such an embodiment makes the boot easier to use during walking, because the guard is always retained by the lever/-loop assembly. Finally, during closing, the operation is carried out very simply because it is sufficient to exert a single action on the end of the lever to cause it to pivot and consequently exert its pull on the end of the cord.

I claim:

1. A closing device for ski boots and the like, including a strapping (7) comprising a flexible cord (8) in the form of a closed loop, having a first end (10) adjustably secured to a first edge (5) of a collar portion (4) of the boot allowing it to be opened and a second end (14) which is operatively connected to a pivoting lever (9) pivotable about a pivot pin (11) provided on a second edge (6) of said collar portion of said boot allowing it to be opened and to exert a pull to ensure closing of the boot, said pivoting lever (9) being mounted permanently on the boot and having, over its length, a continuous slot (15), in which the end (10) of the loop (8) on which the pull is exerted slides freely, such that the two ends (10,14) of the flexible cord (8) in the form of a closed loop are kept permanently on either side of the two edges (5,6) of the boot allowing it to be opened and closed.

2. A device as claimed in claim 1, used on a rear-opening ski boot, said boot comprising a shell (1) intended for receiving the foot, a rear guard (3) mounted pivotally on said shell (1) and a collar (4) making it possible, in interaction with the rear guard (3), to grip the leg, wherein said first end (10) of the loop (8) is mounted fixedly for adjustable movement on said first edge (5) of the collar (4), whilst the lever (9) is likewise mounted fixedly on a pivot pin (11) on said second edge (6) of the collar (4).

3. A device as claimed in claim 2, wherein the lever (9) is secured by means of a base (12) attached of rivets (13) in a recess made during the molding of the collar (4).

4. A device as claimed in claim 3, wherein the slot (15) provided in the lever (9) has the same radius of curvature as the latter, so that, when the boot is closed, it can be laid against the surface of the recess of which the base (12) is secured.

5. A device as claimed in claim 2 wherein said first end (10) of the loop (8) is secured to said first edge (5) by means of stop (16) arranged along a tongue (17) which forms an integral part of said first edge (5) and which projects at the rear of the boot, so as to cover this rear part at least partially.

6. A device as claimed in claim 1 wherein said first end (10) of the loop (8) mounted within the slot (15) is covered with a sheath making it easier for it to slide within the slot and preventing the loop from become worn during use.

* * * * *